US009671734B2

(12) United States Patent
Akiba

(10) Patent No.: US 9,671,734 B2
(45) Date of Patent: Jun. 6, 2017

(54) CONTROL DEVICE, IMAGE FORMING APPARATUS, AND CONTROL METHOD

(71) Applicant: Katsuya Akiba, Kanagawa (JP)

(72) Inventor: Katsuya Akiba, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/059,265

(22) Filed: Mar. 2, 2016

(65) Prior Publication Data

US 2016/0259286 A1 Sep. 8, 2016

(30) Foreign Application Priority Data

Mar. 3, 2015 (JP) ..... 2015-041703
Mar. 1, 2016 (JP) ..... 2016-039338

(51) Int. Cl.
*G03G 15/00* (2006.01)
*G03G 15/08* (2006.01)

(52) U.S. Cl.
CPC ..... *G03G 15/55* (2013.01); *G03G 15/556* (2013.01); *G03G 15/0877* (2013.01); *G03G 15/0879* (2013.01)

(58) Field of Classification Search
CPC ..... G03G 15/0836; G03G 15/0837; G03G 15/0868; G03G 15/087; G03G 15/0872; G03G 15/0879; G03G 2215/0685; G03G 15/55–15/556
See application file for complete search history.

(56) References Cited

U.S. PATENT DOCUMENTS 6,151,471 A * 11/2000 Yahata ..... G03G 15/0822 399/258
7,536,122 B2 * 5/2009 Ohkawa ..... G03G 15/0856 399/27
7,650,087 B2 * 1/2010 Nagata ..... G03G 15/0886 399/119
8,879,115 B2 11/2014 Harano
(Continued)

FOREIGN PATENT DOCUMENTS

JP 2011-224831 11/2011
JP 2014-157350 8/2014

*Primary Examiner* — David M Gray
*Assistant Examiner* — Carla Therrien
(74) *Attorney, Agent, or Firm* — Duft Bornsen & Fettig, LLP

(57) ABSTRACT

A control device drives a main driving device among driving devices each used to discharge recording material from a recording material container. A malfunction detector detects malfunction of the main driving device. When the malfunction detector has detected the malfunction, a recording material amount setting unit sets information indicating an amount of the recording material in the recording material container connected to the main driving device to a first value. A main driving device switching unit stops, when an amount of the recording material in the recording material container connected to the main driving device is the first value, driving the main driving device and then, when the driving devices other than the main driving device include one driving device having a recording material container connected thereto that contains a recording material an amount of which exceeds the first value, switches the main driving device to the one driving device.

9 Claims, 12 Drawing Sheets

(56) References Cited

U.S. PATENT DOCUMENTS

| | | | | |
|---|---|---|---|---|
| 9,360,816 | B1 * | 6/2016 | Mabuchi | G03G 15/0831 |
| 2016/0041498 | A1 * | 2/2016 | Terai | G03G 15/0865<br>399/262 |

* cited by examiner

FIG.7

| TONER STORING INFORMATION | RECORDING MATERIAL AMOUNT INFORMATION OF TONER STORING UNIT | MAIN DRIVING DEVICE INDENTIFICATION INFORMATION | BOTTLE DRIVING DEVICE IDENTIFICATION INFORMATION | BOTTLE RECORD-ING MATERIAL AMOUNT INFORMATION | CONNECTION INFORMATION | STATE INFORMATION |
|---|---|---|---|---|---|---|
| xxx | 200 | YES<br>NO | 001 | 500 | YES | NO |
| | | | 002 | 1000 | YES | NO |
| yyy | 200 | NO<br>YES | 010 | 0 | YES | YES |
| | | | 011 | 900 | YES | NO |
| zzz | 200 | NO<br>YES | 020 | 0 | NO | YES |
| | | | 021 | 800 | YES | NO |
| aaa | 0 | NO<br>YES | 030 | 0 | NO | YES |
| | | | 031 | 0 | YES | NO |

FIG.13

| TONER STORING INFORMATION | RECORDING MATERIAL AMOUNT INFORMATION OF TONER STORING UNIT | MAIN DRIVING DEVICE INDENTIFICATION INFORMATION | BOTTLE DRIVING DEVICE IDENTIFICATION INFORMATION | BOTTLE RECORD-ING MATERIAL AMOUNT INFORMATION | CONNECTION INFORMATION | STATE INFORMATION |
|---|---|---|---|---|---|---|
| xxx | 200 | YES<br>NO | 001 | 500 | YES | YES |
| | | | 002 | 1000 | YES | NO |
| yyy | 200 | NO<br>YES | 010 | 0 | YES | YES |
| | | | 011 | 900 | YES | NO |
| zzz | 200 | NO<br>YES | 020 | 0 | NO | YES |
| | | | 021 | 800 | YES | NO |
| aaa | 0 | NO<br>YES | 030 | 0 | NO | YES |
| | | | 031 | 0 | YES | NO |

CONTROL DEVICE, IMAGE FORMING APPARATUS, AND CONTROL METHOD

CROSS-REFERENCE TO RELATED APPLICATIONS

The present application claims priority to and incorporates by reference the entire contents of Japanese Patent Application No. 2015-041703 filed in Japan on Mar. 3, 2015 and Japanese Patent Application No. 2016-039338 filed in Japan on Mar. 1, 2016.

BACKGROUND OF THE INVENTION

1. Field of the Invention

The present invention relates to a control device, an image forming apparatus, and a control method.

2. Description of the Related Art

Conventionally, there has been known an image forming apparatus including a control device (an information processing unit) that controls driving in a plurality of toner bottle driving devices to and from which corresponding toner bottles filled with toner, which is one example of recording material, can be attached and removed. Each of the toner bottle driving devices causes toner to be discharged from a toner bottle connected thereto (attached thereto) to replenish a toner storing unit with toner.

For example, Japanese Patent Application Publication No. 2014-157350 discloses an image forming apparatus that includes a toner replenishing device in which two toner bottles are mounted, and can thus continue printing operation with toner being supplied from one of the toner bottles even after the other toner bottle has become empty.

However, there has not been a mechanism by which, when a malfunction occurs in a toner bottle driving device currently in use while the other toner bottle driving devices include a usable (normally functioning) toner bottle driving device, the toner bottle driving device currently in use is switched to the usable toner bottle driving device.

SUMMARY OF THE INVENTION

It is an object of the present invention to at least partially solve the problems in the conventional technology.

According to an embodiment, a control device drives a main driving device among a plurality of driving devices each used to discharge recording material from a recording material container filled with the recording material to replenish, with the recording material, a recording material storing unit that stores the recording material. The main driving device has the recording material container connected thereto and is intended to be driven. The control device includes a malfunction detector, a recording material amount setting unit, and a main driving device switching unit. The malfunction detector detects malfunction of the main driving device. When the malfunction detector has detected the malfunction of the main driving device, the recording material amount setting unit sets information indicating an amount of the recording material in the recording material container connected to the main driving device to a first predetermined value. The main driving device switching unit stops, when an amount of the recording material in the recording material container connected to the main driving device is the first predetermined value, driving the main driving device and then, when the driving devices other than the main driving device include one driving device having a recording material container connected thereto that contains a recording material an amount of which exceeds the first predetermined value, switches the main driving device to the one driving device.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 7 is a diagram illustrating one example of association information table;

FIG. 13 is a table illustrating one example of updated association information.

DETAILED DESCRIPTION OF THE PREFERRED EMBODIMENTS

The following describes in detail, with reference to the accompanying drawings, an embodiment. In the following description, toner is given as an example of a recording material to which the present invention is applied. However, the present invention is not limited to this example (and may be applied to ink, for example).

Figure 1:
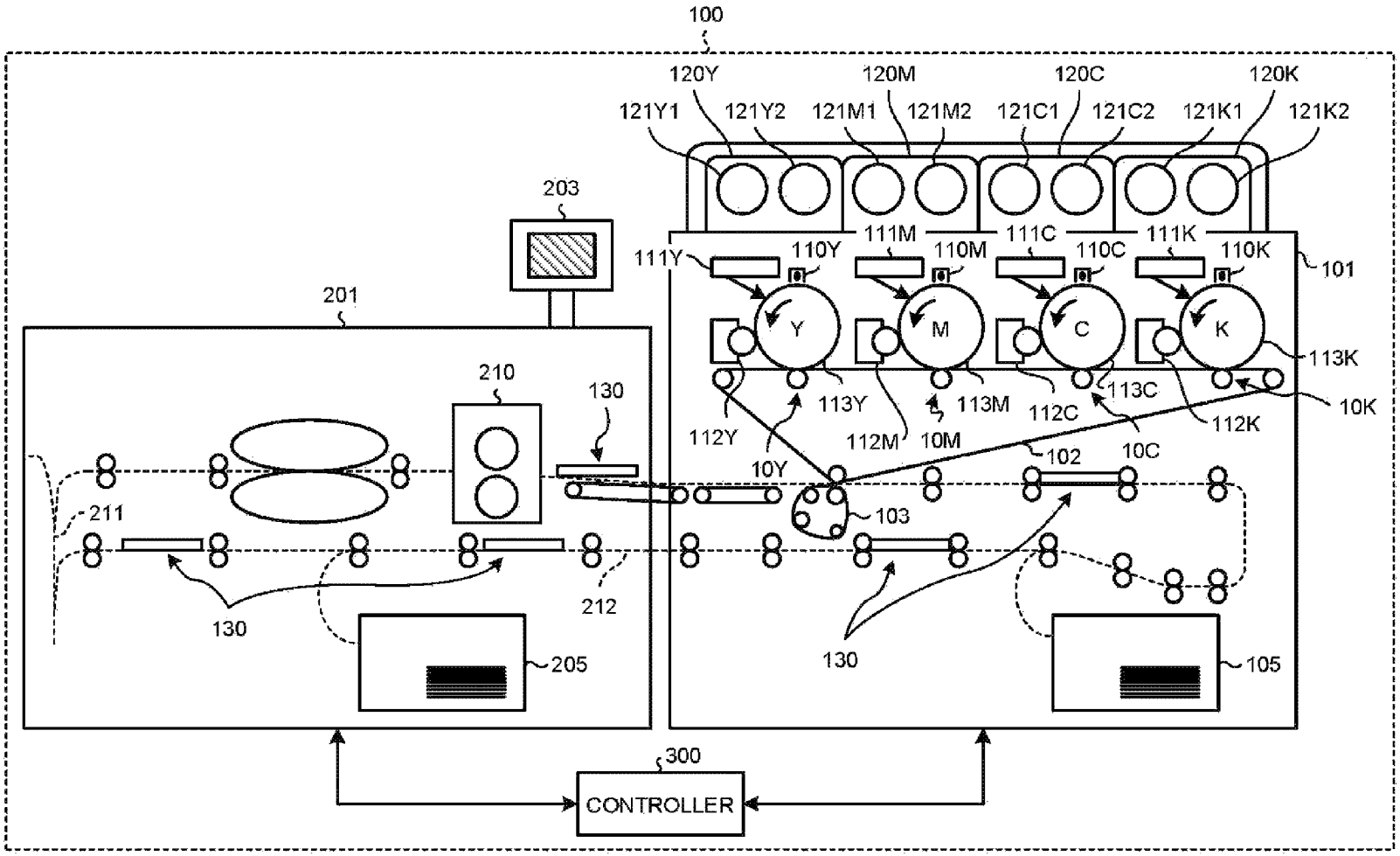
FIG. 1 is a diagram illustrating one example of the hardware configuration of an image forming apparatus.

FIG. 1 is a diagram illustrating one example of the hardware configuration of an image forming apparatus 100 according to the present embodiment. The image forming apparatus 100 may be, for example, a multifunction peripheral (MFP). An MFP is an apparatus having a plurality of different functions such as a copy function, a scanner function, a printing function, and a facsimile function.

In the example in FIG. 1, the image forming apparatus 100 includes an image forming section 101, a fixing section 201, and a controller 300. The image forming section 101 includes an intermediate transfer belt 102 in the center thereof. The image forming section 101 further includes image forming units 10Y, 10M, 10C, and 10K for generating toner images of yellow, magenta, cyan, and black (denoted as Y, M, C, and K hereinafter) provided side by side so as to face the intermediate transfer belt 102. Toner replenishing devices 120 each including a plurality of bottle driving devices (exemplary driving devices) are provided in a space above the image forming units 10Y, 10M, 10C, and 10K for the respective four colors of C, M, Y, and K. A toner bottle (an exemplary recording material container) filled with toner of a corresponding color can be attached to and removed from each of the bottle driving devices. Under the control of the controller 300, the bottle driving device performs operation to cause toner to be discharged from the toner bottle attached thereto to replenish a toner storing unit (an exemplary recording material storing unit) with toner. Toner that the toner bottle of each color is filled with is supplied by the toner replenishing device 120 corresponding to the color to a developing unit 112 corresponding to the color. The developing unit 112 is to be described later.

Each of the four image forming units 10Y, 10M, 10C, and 10K includes a photoconductor drum 113 and components arranged around the photoconductor drum 113 such as a charging unit 110, an exposure unit 111, and the developing unit 112. In the example of FIG. 1, the charging unit 110 that corresponds to C is denoted as "110C", the exposure unit 111 that corresponds to C is denoted as "111C", and the developing unit 112 that corresponds to C is denoted as "112C". Similar denotations are used for the other colors. A well-known image forming process (charging, exposure, developing, and cleaning) is performed on the photoconductor drums 113. An image of the color corresponding to each of the photoconductor drums 113Y, 113M, 113C, and 113K is formed on that photoconductor drum through these processes. Thereafter, toner images of the respective colors are primarily transferred onto the intermediate transfer belt 102, so that the toner images of the four colors are overlaid on each other on the intermediate transfer belt 102.

A recording medium 130 fed from a sheet feeding device 105 or a sheet feeding device 205 is conveyed to a nip point between the intermediate transfer belt 102 and a secondary transfer belt 103 in parallel with these processes, so that toner images overlaid on the intermediate transfer belt 102 is transferred to the recording medium 130.

Thereafter, the recording medium 130 having the transferred images thereon is conveyed to a fixing device 210 in the fixing section 201 to be subjected to heat and pressure, so that the transferred images are melted and adhere to the recording medium 130. Thereafter, if duplex printing is performed to print images on a first page of the recording medium 130 and then on a second page back of the first page, the recording medium 130 is conveyed to a sheet reversing path 211 and a duplex conveying path 212. A composite color image is formed on the back side of the recording medium 130 in a manner similar to the above-described manner. The fixing section 201 is provided with a display device 203. On the display device 203, information indicating, for example, the state of the image forming apparatus 100 is displayed.

Figure 2:
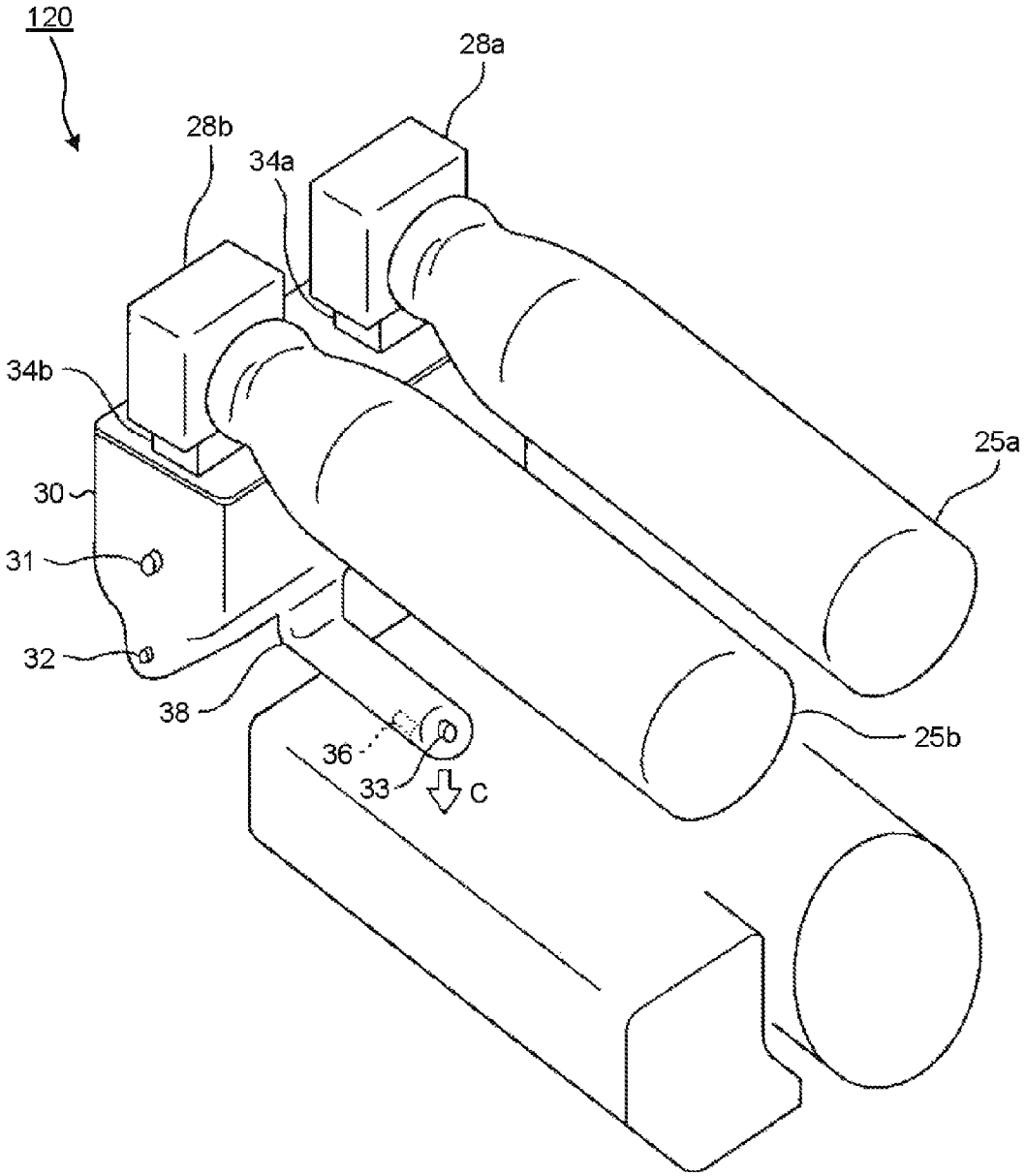
FIG. 2 is a view illustrating one example of the schematic configuration of a toner replenishing device.

FIG. 2 is a view illustrating one example of the schematic configuration of the toner replenishing device 120. Although FIG. 2 illustrates one of the toner replenishing devices 120 that corresponds to any one color of C, M, Y, and K, the configurations of the toner replenishing devices 120 corresponding to the other colors are the same as the configuration illustrated in FIG. 2. As illustrated in FIG. 2, a toner storing unit 30 is arranged below two bottle driving devices 28*a* and 28*b* corresponding one-to-one to two toner bottles 25*a* and 25*b* provided in parallel with each other. The toner storing unit 30 temporarily stores toner discharged from the toner bottles 25*a* and 25*b*. The toner storing unit 30 includes a pipe-like toner supply path 38 through which toner is conveyed from inside the toner storing unit 30 toward a toner feeding port 36. The toner supply path 38 is provided so as to project substantially in parallel with the axial direction of the toner bottles 25*a* and 25*b* from a central part of the bottom of the toner storing unit 30 in a direction in which the toner bottles are arranged, and extends below the toner bottles 25*a* and 25*b*. In the following description, each of the toner bottles 25*a* and 25*b* may be referred to simply as the "toner bottle 25" when distinguishing between them is not necessary.

Figure 3B:
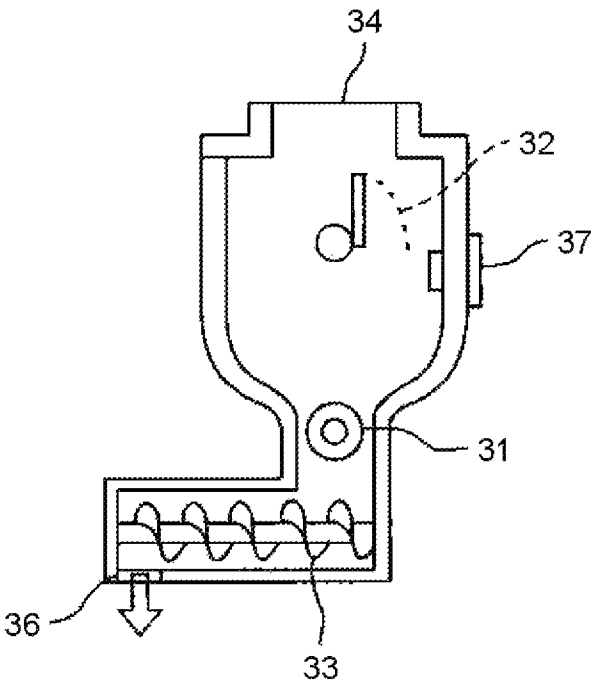
FIG. 3B is another view illustrating the example of the schematic configuration of a toner storing unit.
Figure 3A:
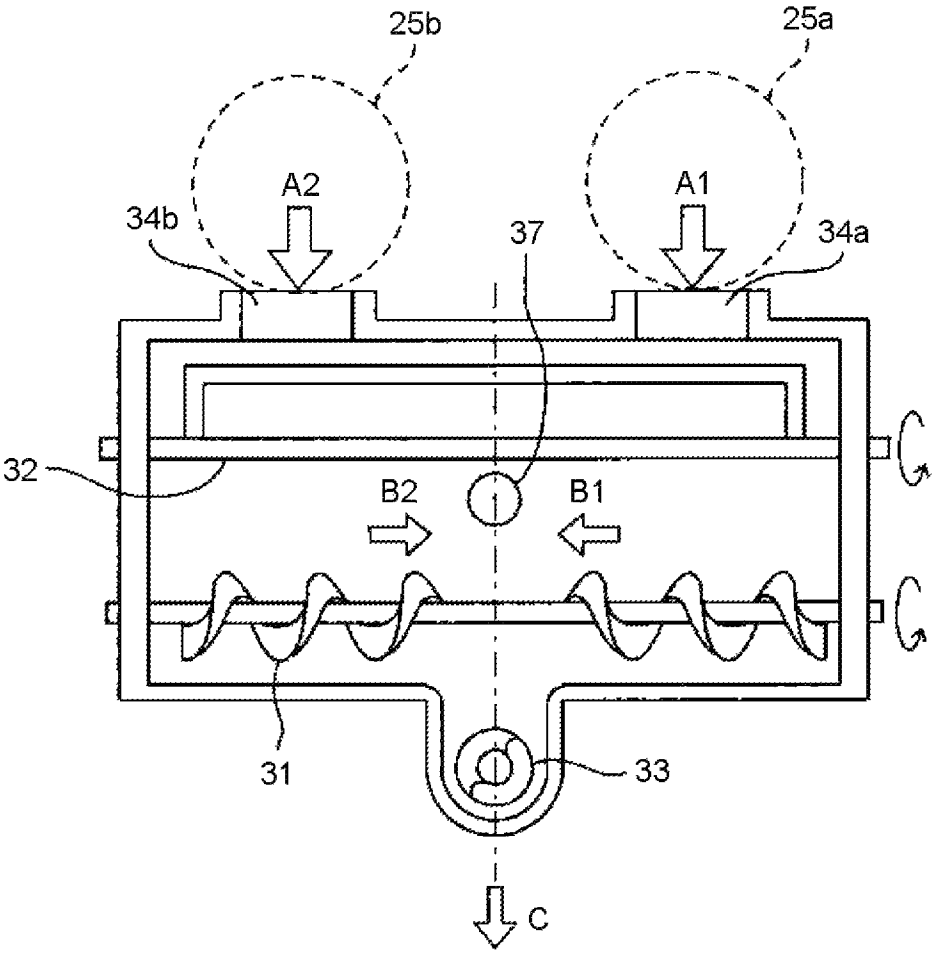
FIG. 3A is a view illustrating one example of the schematic configuration of a toner storing unit.

FIG. 3A and FIG. 3B are views illustrating one example of the schematic configuration of the toner storing unit 30. FIG. 3A is a view illustrating a section (a section taken in a direction perpendicular to the longitudinal direction of the toner bottles 25) taken in the direction in which the toner bottles 25 are arranged, and FIG. 3B illustrates a section taken in the longitudinal direction of the toner bottles 25. The top part of the toner storing unit 30 has toner receiving ports 34*a* and 34*b* that receive toner discharged from the two toner bottles 25*a* and 25*b*, respectively. In the lower part of the toner storing unit 30, a first screw 31 is provided as a first toner conveying member that conveys toner from portions below the two toner receiving ports 34*a* and 34*b* inward in directions in which the toner bottles 25 are arranged, that is, in counter directions. The first screw 31 includes, so as to convey toner in the counter directions when rotating, spiral parts wound oppositely, clockwise and counterclockwise, about the rotation axis.

Inside the toner supply path 38, a second screw 33 including a spiral part continuously wound about the rotation axis is provided as a second toner conveying member that conveys toner from inside the toner storing unit 30 toward the toner feeding port 36. The rotation axes of the two screws, namely, the first screw 31 and the second screw 33, orthogonally cross over each other at vertically different points, that is, with the phases thereof having different orientations. Above the first screw 31 in the toner storing unit 30, an agitator 32 is arranged as an agitating member the rotation axis of which is parallel to the rotation axis of the first screw 31. A toner sensor 37 for sensing the presence of toner inside the toner storing unit 30 is provided on wall surfaces of the toner storing unit 30. The controller 300 samples output from the toner sensor 37 at certain time intervals. When a result of the sampling leads to determination that the amount of toner inside the toner storing unit 30 is zero, the controller 300 performs control for driving a main driving device and control for rotating the agitator 32 at the same time, thereby supplying (replenishing) the toner storing unit 30 with toner. The "main driving device" herein implies one of the bottle driving devices 28 that has the toner bottle 25 attached thereto and that is intended to be driven (the bottle driving device 28 currently in use).

Figure 4A:
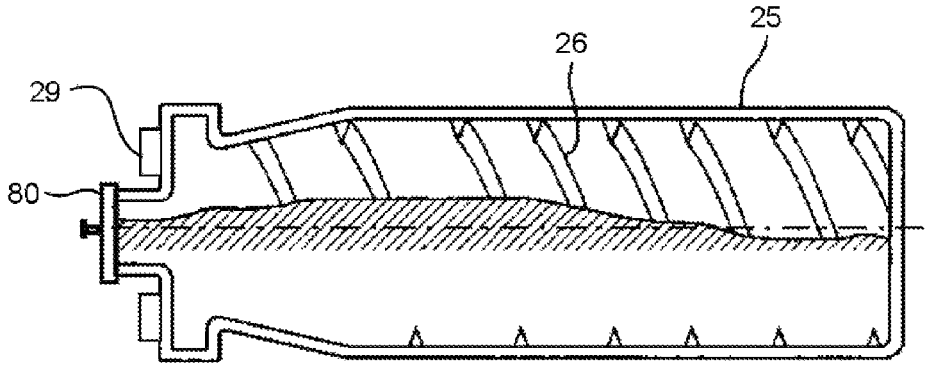
FIG. 4A is a view for explaining a toner bottle and a bottle driving device.
Figure 4B:
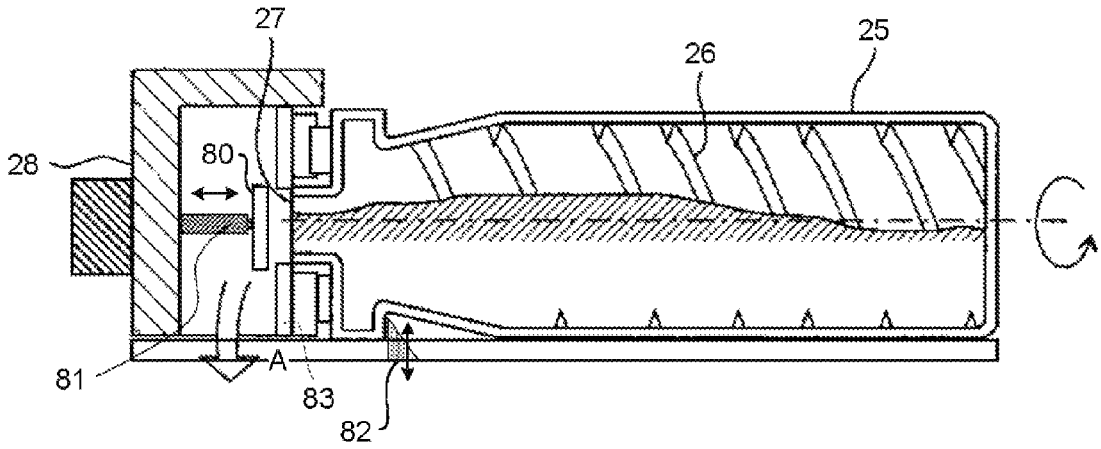
FIG. 4B is another view for explaining a toner bottle and a bottle driving device.

FIG. 4A and FIG. 4B are views for explaining the toner bottle 25 and the bottle driving device 28. Although each one of the toner storing units 30 is provided with two bottle driving devices 28 having the same shape in the present embodiment, one of the bottle driving devices 28 and one of the toner bottles 25 are illustrated as the examples in FIG. 4A and FIG. 4B.

As illustrated in FIG. 4A, spiral grooves 26 and a cap 80 are provided on inner walls of the toner bottle 25, and, when the toner bottle 25 rotates, toner inside moves in one direction of the bottle and is discharged from a toner discharge port 27 at an end of the bottle. There is no need to provide any components as a conveying member in the toner bottle 25.

FIG. 4B is a view illustrating a state where toner can be supplied from the toner bottle 25 attached to the bottle driving device 28. In response to the attachment (connection) of the toner bottle 25, a bottle detection lock part 82 detects that a toner bottle has been attached (connected).

A main bottle, which means the toner bottle 25 that has been attached to a main driving device, has the cap 80 opened by a cap opening-closing part 81 provided to the main driving device (the bottle driving device 28), and is kept in an irremovable state due to the bottle detection lock part 82. When the main bottle is thus attached, a rib 29 of the main bottle engages with a bottle driving mechanism 83 of the bottle driving device 28. The main bottle is rotated when a bottle driving motor of the bottle driving device 28 causes the bottle driving mechanism 83 to rotate. At least while the bottle driving device 28 performs the driving (the main bottle is rotated), the controller 300 samples, at certain time intervals, output from an electric-current detecting mechanism that detects an electric-current value of the bottle driving motor.

When the main bottle becomes empty, the lock is released at the same time as the cap 80 is closed, and then the toner bottle 25 can be removed. When the toner bottle 25 is removed, the bottle detection lock part 82 detects that there is no bottle connected. When one of the toner bottles 25 (the main bottle) becomes empty with an unused toner bottle attached as the other attached toner bottle 25, the cap 80 of the other attached toner bottle 25 is opened, and that toner bottle 25 is locked (the main bottle is switched). Thus, even when there are respective toner bottles 25 attached to both of the two bottle driving devices 28, there is always only one of the toner bottles 25 (the main bottle) that has the cap 80 thereof opened and that can supply toner to the toner storing unit 30. In addition, the toner bottle 25 that can supply toner is controlled so as to be irremovable until it becomes empty.

Figure 5:
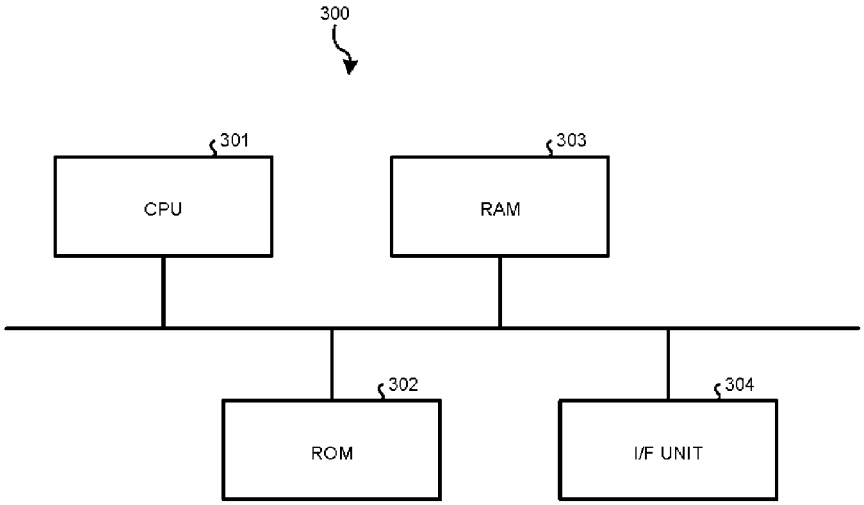
FIG. 5 is a diagram illustrating one example of the hardware configuration of a controller.

FIG. 5 is a diagram illustrating one example of the minimum necessary hardware configuration of the controller 300. As illustrated in FIG. 5, the controller 300 includes a central processing unit (CPU) 301, a read only memory (ROM) 302, a random access memory (RAM) 303, and an I/F unit 304. The CPU 301 integrally controls operation of the image forming apparatus 100. The CPU 301 controls operation of the image forming apparatus 100 by executing a computer program stored in the ROM 302 or the like while using the RAM 303 as a work area. The I/F unit 304 is an interface for connection with external apparatuses (such as the image forming section 101 and the fixing section 201).

Figure 6:
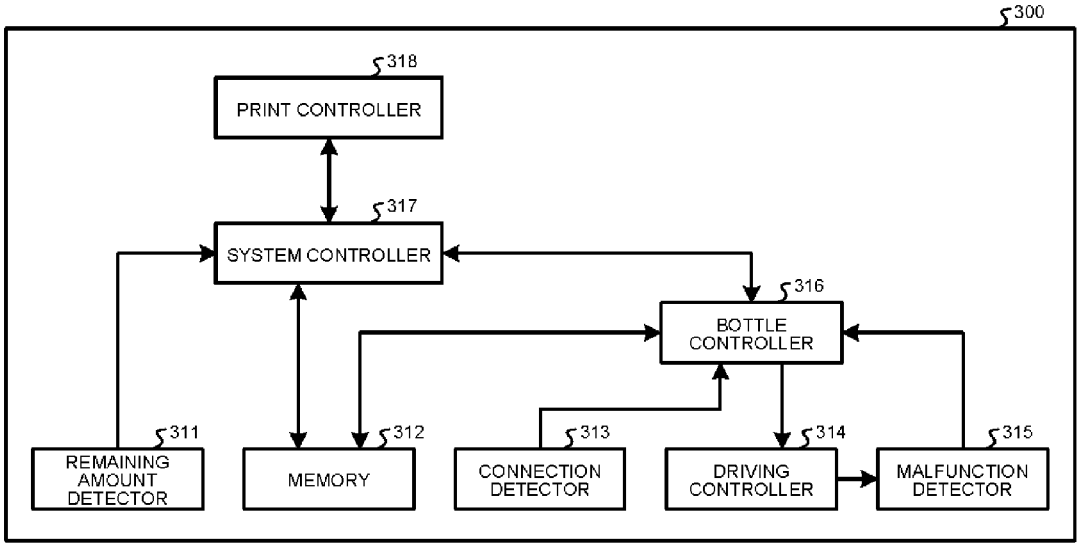
FIG. 6 is a diagram illustrating exemplary functions in the controller.

FIG. 6 is a diagram illustrating exemplary functions of the controller 300. For the convenience of explanation, FIG. 6 mainly illustrates the functions related to the present invention. However, functions in the controller 300 are not limited to these functions. As illustrated in FIG. 6, the controller 300 includes a remaining amount detector 311, a memory 312, a connection detector 313, a driving controller 314, a malfunction detector 315, a bottle controller 316, a system controller 317, and a print controller 318.

The remaining amount detector 311 has a function of detecting a remaining amount of toner inside the toner storing unit 30. When the toner sensor 37 has determined that the amount of toner inside the toner storing unit 30 is smaller than a second predetermined value, the remaining amount detector 311 notifies the system controller 317 of a request for toner replenishment. The second predetermined value is a value used to determine whether the toner replenishment to the toner storing unit 30 is needed or not (a value used to determine whether the main driving device is to be driven or not). In this example, the second predetermined value is set to zero, but does not limited to this.

The memory 312 stores information in a device region, or acquires information from a device region. The memory 312 stores information in a region specified by the system controller 317 or the bottle controller 316, acquires information from a region specified by the system controller 317 or the bottle controller 316.

The connection detector 313 has a function of detecting, for each plurality of bottle driving devices 28, whether toner bottles 25 are attached. The connection detector 313 checks, based on output from the bottle detection lock part 82 of each of the bottle driving devices 28, whether the toner bottle 25 is connected to that bottle driving device 28.

The driving controller 314 has a function of driving and stopping each of the bottle driving devices 28 individually and a function of notifying the malfunction detector 315 of information indicating a state of each of the bottle driving devices 28, i.e., a drive state or stop state. In response to reception of a drive request that requests driving of the bottle driving device 28 from the bottle controller 316, the driving controller 314 drives the bottle driving device 28 and notifies the malfunction detector 315 of a drive state of the bottle driving device 28.

The malfunction detector 315 has a function of detecting malfunction of the bottle driving device 28 based on the notification of the drive state or the stop state received from the driving controller 314. When receiving the drive state of the bottle driving device 28, the malfunction detector 315 performs detection of malfunction of the bottle driving device 28 (the main driving device). If the malfunction detector 315 has detected the malfunction, the malfunction detector 315 notifies the bottle controller 316 of malfunctioning state information indicating the malfunctioning state. In this example, the malfunction detector 315 has a function of detecting malfunction of the main driving device.

The bottle controller 316 controls the driving of the bottle driving device 28 (in other words, controls the drive controller 314) based on control instruction from the system controller 317. The bottle controller 316 has a function of obtaining bottle recording material amount information indicating an amount of toner in the toner bottle 25, and a function of storing the bottle recording material amount information in the memory 312. In this example, association information is stored in the memory 312, but is not limited to this example. The association information can be stored in any location. Details of the association information illustrated in FIG. 7 will be described hereinafter. The bottle controller 316 also has a function of storing the malfunctioning state information received from the malfunction detector 315 in the memory 312. In this example, an association information table includes information (association information) in which pieces of state information indicating whether the respective bottle driving devices 28 are malfunctioning are associated with the respective bottle driving devices 28. The bottle controller 316 has a function (i.e., a state information setting unit) of setting the state information associated with the main driving device, among the pieces of state information included in the association information table, to the state information indicating the malfunctioning state when the malfunction detector 315 has detected the malfunction of the main driving device. The bottle controller 316 also has a function of obtaining, from the connection detector 313, connection information indicating whether the main driving device has the toner bottle 25 connected thereto. The bottle controller 316 also has a function of instructing the driving controller 314 to drive or stop the bottle driving device 28.

The bottler controller 316 also has a function of setting the bottle recording material amount information, which corresponds to the bottle driving device 28 having been detected as a malfunctioning state, to a first predetermined value. The first predetermined value is a value used for determining whether the bottle driving device 28 is stopped. In this example, the first predetermined value is set to zero, but is not limited to this example. In this example, the bottle controller 316 has a function (i.e., a recording material amount setting unit) of setting an amount of toner inside the toner bottle 25 to the first when the malfunction detector 315 has detected the malfunction of the main driving device.

The system controller 317 has a function of clearing the malfunctioning state indicated by the bottle malfunctioning state information received from the memory when power is turned ON. In this example, the system controller 317 has a function (i.e., a state information initializing unit) of initializing (resetting) all of the pieces of state information associated with the respective bottle driving devices 28 to state information indicating that they are not malfunctioning, in a case where all the pieces of state information associated with the respective bottle driving 28 indicate that they are malfunctioning when the power supply to the controller 300 is started (the power is turned on). The system controller 317 also has a function of instructing the bottle controller 316 to control the bottle driving device 28 based on a notification of a request for toner replenishment (a notification indicating that an amount of toner inside the toner storing unit 30 is the second predetermined value), the bottle recording material amount information of the bottle driving devices 28 obtained from the memory 312, and the association information table, and has a function of determining whether printing can be performed or not. When receiving the notification indicating that the amount of toner inside the toner bottle 25 is the first predetermined value, the system controller 317 searches for the bottle driving device 28 having the toner bottle 25 connected thereto that contains toner the amount of which exceeds the first predetermined value by referring to the association information table illustrated in FIG. 7. As a result of the search, when the bottle driving device 28 having the toner bottle 25 connected thereto that contains toner the amount of which exceeds the first predetermined value is present, the main driving unit is switched to the bottle driving device 28 thus searched for. In this example, when the amount of toner inside the toner bottle 25 connected to the main driving device is the first predetermined value, the system controller 317 stops driving the main driving device, and then, when the other bottle driving devices 28 includes any bottle driving device 28 having the toner bottle 25 connected thereto that contains toner the amount of which exceeds the first predetermined value, the system controller 317 switches the main driving device to that bottle driving device 28, which newly serves as the main driving device 28. Thus, the system controller 317 functions as a driving device switching unit. The print controller 318 has a function of controlling printing operation under control of the system controller 317.

In the present embodiment, the processes performed by the remaining amount detector 311, the connection detector 313, the driving controller 314, the bottle controller 316, and the system controller 317 are repeated at certain time intervals (every several hundred milliseconds, for example). In this example, when the remaining amount detector 311 has successively determined the amount of toner inside the toner storing unit 30 a certain number of times to be the second predetermined value, the bottle controller 316 sets the amount of toner in the toner bottle 25 connected to the main driving device to the first predetermined value. More specific details are to be described later.

In the present embodiment, the above-described functions of the units in the controller 300 are implemented when the CPU 301 of the controller 300 executes computer programs stored in, for example, the ROM 302. However, the present embodiment is not limited to this implementation, and at least part of the above-described functions of the units in the controller 300 may be implemented by a dedicated hardware circuit (such as a semiconductor integrated circuit).

The controller 300 can be regarded as corresponding to a "control device" in the claims, and a combination of the controller 300 and the toner replenishing devices 120 can be regarded as a "recording material replenishing device" in the claims.

FIG. 7 is a diagram illustrating one example of the association information table. As illustrated in FIG. 7, the association information is information in which pieces of toner storing information, pieces of recording material amount information of toner storing unit, pieces of main driving device identification information, pieces of bottle driving device identification information, pieces of bottle recording material amount information, pieces of connection information, and pieces of state information in an associated manner in a tabular form. The toner storing information is information indicating output from the toner sensor 37 (information serving as a comparison target to be compared with the second predetermined value). The recording material amount information of toner storing unit is information indicating an amount of recording material usable for printing after an amount of toner in the toner storing unit 30 reaches the second predetermined value. The main driving device identification information is information used for identifying a main driving device from among the bottle driving devices 28. When serving as a main driving device, the main driving device identification information thereof presents "YES". The bottle driving device identification information is information used for identifying a bottle driving device 28. The bottle recording material amount information is information indicating an amount of toner inside the toner bottle. In the present embodiment, the bottle controller 316 first sets the amount of toner inside the toner bottle 25 to an initial value. Thereafter, the amount of toner in the toner bottle 25 is reduced according to use of toner. When the bottle driving device 28 being driven has been detected to be malfunctioning, the amount of toner in the toner bottle 25 is set to zero (the first predetermined value). Furthermore, when the toner bottle 25 is not connected to the bottle driving device 28, the amount of toner in the toner bottle 25 is set to zero. That is, the bottle recording material amount information associated with the bottle driving device identification information that identifies the bottle driving device 28 is set to zero. When the toner bottle 25 is connected to the bottle driving device 28 at a time of clearing the malfunction state, the amount of toner in the toner bottle 25 is set to the initial value.

The connection information is information indicating whether the toner bottle 25 is connected to the bottle driving device 28. When the toner bottle 25 is connected, the connection information presents "YES". When the toner bottle 25 is not connected, the connection information presents "NO". The state information is information indicating whether the bottle driving device 28 is malfunctioning. When the bottle driving device 28 is malfunctioning, the state information presents "YES". When the bottle driving device 28 is not malfunctioning (normally functioning), the state information presents "NO".

Figure 8:
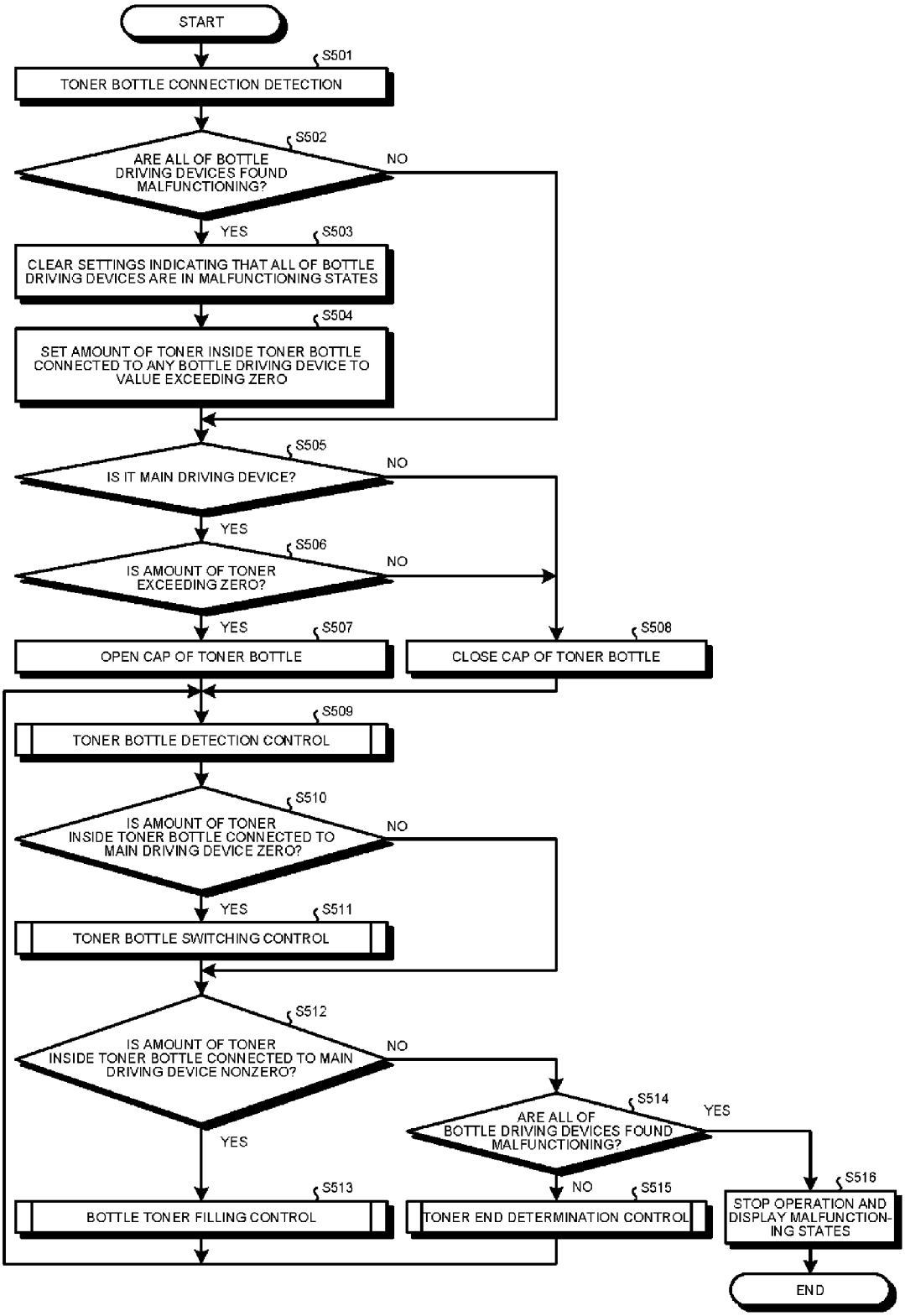
FIG. 8 is a flowchart illustrating an exemplary control method that the controller uses.

FIG. 8 is a flowchart illustrating an exemplary control method that the controller 300 according to the present embodiment uses. When the power supply is turned on, the controller 300 (the connection detector 313) checks, for each plurality of bottle driving devices 28, whether each of the bottle driving devices 28 have a toner bottle 25 connected thereto (Step S501). The controller 300 (the system controller 317) then refers to the association information to determine whether all of the bottle driving devices 28 are malfunctioning (Step S502).

If all of the bottle driving devices 28 have been determined to be malfunctioning (Yes at Step S502), the controller 300 (the system controller 317) clears settings indicating that all of the bottle driving devices 28 are malfunctioning (Step S503). Using the result of Step S501, the controller 300 (the bottle controller 316) then sets the amount of toner inside a toner bottle 25 connected to any of the bottle driving devices 28 to a value (for example, a value corresponding to its full capacity) exceeding the first predetermined value (Step S504), and the process proceeds to Step S505. On the other hand, if at least one of the bottle driving devices 28 has been determined not to be malfunctioning (No at Step S502), the process proceeds to Step S505.

At Step S505, the controller 300 (the system controller 317) sequentially takes the bottle driving devices 28 one by one, and determines whether the driving device currently taken is a main driving device. In this example, for each plurality of bottle driving devices 28, the controller 300 (the system controller 317) refers to the association information table and checks the pieces of main driving device identification information associated with the respective bottle driving devices 28 to determine which one of them is a main driving device.

If the bottle driving device 28 currently taken is a main driving device (Yes at Step S505), the controller 300 (the system controller 317) refers to the foregoing association information to check whether the amount of toner inside the toner bottle 25 connected to the main driving device exceeds zero (remains) (Step S506).

If the amount of toner inside the toner bottle 25 connected to the main driving device exceeds zero (Yes at Step S506), the controller 300 (the system controller 317) performs control for opening the cap 80 of the toner bottle 25 (the main bottle) connected to the main driving device (Step S507). On the other hand, if the amount of toner inside the toner bottle 25 connected to the main driving device is zero (No at Step S506), the controller 300 (the system controller 317) performs control for closing the cap 80 of the toner bottle 25 connected to the main driving device (Step S508). If the result of Step S505 above is negative (No at Step S505), the controller 300 (the system controller 317) also performs control for closing the cap of the toner bottle 25 connected to the bottle driving device 28 currently taken (Step S508).

The controller 300 then repeats execution of the subsequent processes. First, the controller 300 performs toner bottle detection control (Step S509). In the toner bottle detection control, for each plurality of bottle driving devices 28, the controller 300 (the connection detector 313) detects whether each of the bottle driving devices 28 has a toner bottle 25 set thereon (connected thereto). If any of the bottle driving devices 28 has a toner bottle 25 set thereon, the controller 300 (the bottle controller 316) checks whether the bottle driving device 28 is in a malfunctioning state. If the bottle driving device 28 is normally functioning, the controller 300 (the bottle controller 316) sets the amount of toner inside the toner bottle 25 connected thereto to a value (for example, a value corresponding to its full capacity) exceeding the first predetermined value. In addition, if a specific one of the bottle driving devices 28 does not have a toner bottle 25 set thereon, the controller 300 (the bottle controller 316) sets the amount of toner inside a toner bottle 25 connected to the specific bottle driving device 28 to zero.

Figure 9:
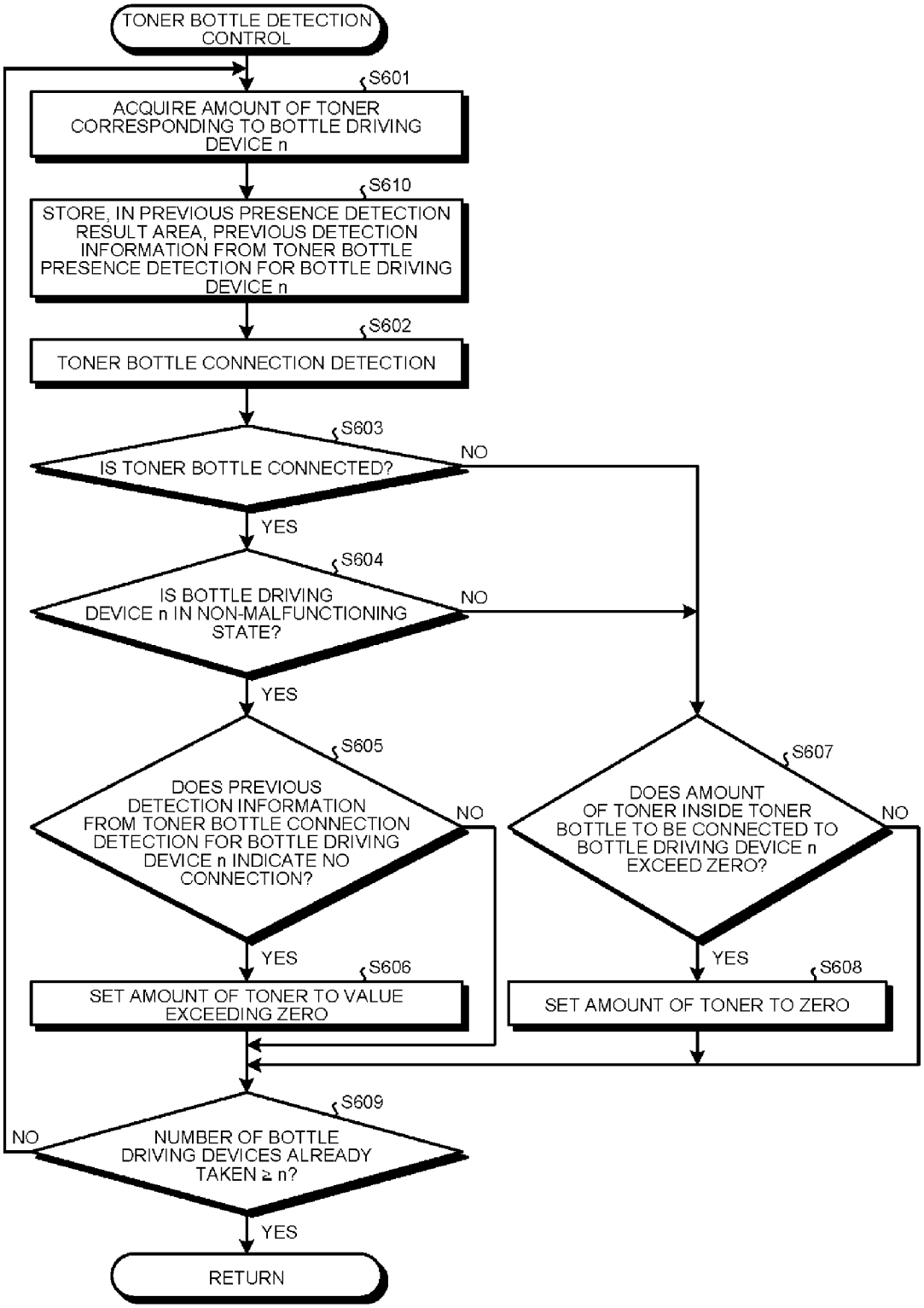
FIG. 9 is a flowchart illustrating exemplary toner bottle detection control.

FIG. 9 is a flowchart illustrating an exemplary specific procedure of the toner bottle detection control. The controller 300 (the bottle controller 316) takes any one of the bottle driving devices 28 (hereinafter, the bottle driving device 28 thus taken is referred to as a "bottle driving device n"), and refers to the foregoing association information table to acquire the amount of toner inside the toner bottle 25 connected to the bottle driving device n (Step S601). The controller 300 (the bottle controller 316) then stores, in a previous presence detection result area (an area inside the controller 300 or inside an external memory), detection information previously obtained by detecting whether a toner bottle 25 is present on the bottle driving device n (previous detection information) (Step S610). The controller 300 (the connection detector 313) then checks whether the bottle driving device n has a toner bottle 25 connected thereto (Step S602). If the bottle driving device n has a toner bottle 25 connected thereto (Yes at Step S603), the controller 300 (the bottle controller 316) refers to the association information table to check whether the bottle driving device n is in a non-malfunctioning state (Step S604).

If the bottle driving device n does not have a toner bottle 25 connected thereto (No at Step S603), the controller 300 (the bottle controller 316) checks whether the amount of toner inside a toner bottle 25 to be connected to the bottle driving device n exceeds zero (Step S607). In addition, if the bottle driving device n has a toner bottle 25 connected thereto (Yes at Step S603) as well as the bottle driving device n is malfunctioning (No at Step S604), the controller 300 (the bottle controller 316) also checks whether the amount of toner inside the toner bottle 25 to be connected to the bottle driving device n exceeds zero (Step S607). If the amount of toner inside the toner bottle 25 to be connected to the bottle driving device n exceeds zero (Yes at Step S607), the controller 300 (the bottle controller 316) sets the amount of toner inside the toner bottle 25 to be connected to the bottle driving device n to zero (Step S608). In essence, the controller 300 (the bottle controller 316) sets the amount of toner inside the toner bottle 25 to be connected to the bottle driving device 28 that is without a toner bottle 25 connected thereto to the first predetermined value (in this example, zero).

On the other hand, at Step S604 above, if the bottle driving device n is not malfunctioning (Yes at Step S604), the controller 300 (the bottle controller 316) checks whether the previous detection information obtained by detecting connection of a toner bottle 25 to the bottle driving device n indicates no connection thereof (indicates that there is no toner bottle 25 connected thereto) (Step S605). If the previous detection information indicates the absence (Yes at Step S605), the controller 300 (the bottle controller 316) sets the amount of toner inside the toner bottle 25 connected to the bottle driving device n to a value (in this example, a value corresponding to its full capacity) exceeding zero (S606). If the previous detection information does not indicate the absence (No at Step S605), the process proceeds to Step S609 to be described later.

Following Step S608 or Step S606, the controller 300 (the bottle controller 316) determines whether the number of the bottle driving devices 28 that have already been taken has reached a prescribed value n (≥2) (Step S609). If the number thereof has not reached the prescribed value n (No at Step S609), the processes starting from Step S601 are repeated.

With reference to FIG. 8 again, further description is given. Subsequently to Step S509, the controller 300 (the system controller 317) checks whether the amount of toner inside the toner bottle 25 connected to the main driving device is zero (Step S510). If the amount of toner connected to the main driving device is zero (Yes at Step S510), the controller 300 (the system controller 317) performs toner bottle switching control (Step S511).

Figure 10:
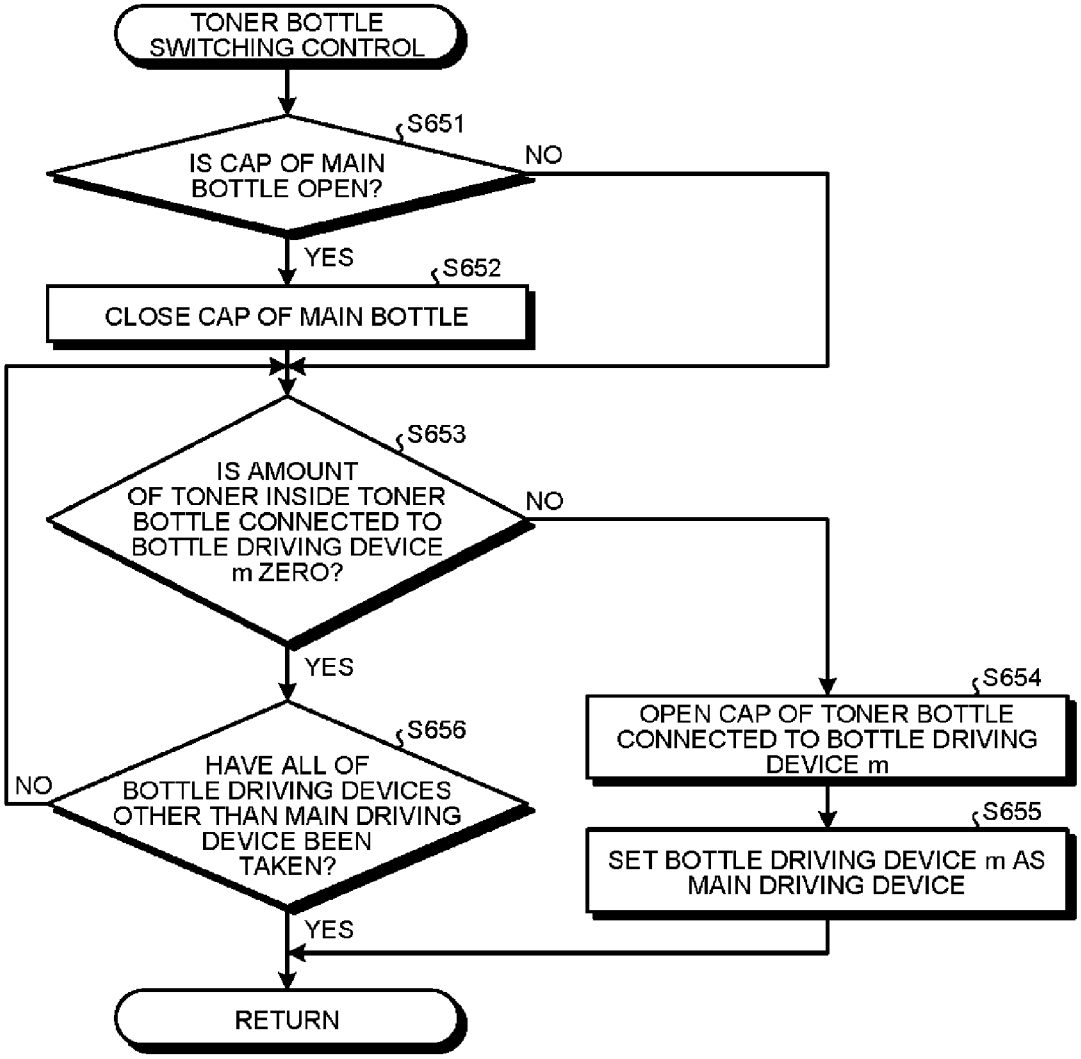
FIG. 10 is a flowchart illustrating exemplary toner bottle switching control.

FIG. 10 is a flowchart illustrating exemplary specific details of the toner bottle switching control. The controller 300 (the system controller 317) checks whether the cap 80 of the main bottle (the toner bottle 25 that is attached to the main driving device) is open (Step S651). If the cap 80 of the main bottle is open (Yes at Step S651), the controller 300 (the system controller 317) performs control for closing the cap 80 of the main bottle (Step S652).

The controller 300 (the system controller 317) then sequentially takes the bottle driving devices 28 other than the main driving device, and checks whether the amount of toner inside the toner bottle 25 connected to the bottle driving device 28 currently taken (hereinafter, referred to as a "bottle driving device m") is zero (Step S653). If the amount of toner inside the toner bottle 25 connected to the bottle driving device m is not zero (No at Step S653), the controller 300 (the system controller 317) performs control for opening the cap of the toner bottle 25 attached to the bottle driving device m (Step S654), and then sets the bottle driving device m as the main driving device (Step S655).

On the other hand, the result of Step S653 above is affirmative (Yes at Step S653), the controller 300 (the system controller 317) checks whether all of the bottle driving devices 28 other than the main driving device have been taken (Step S656). If there is at least one of those bottle driving devices 28 that has not been taken (No at Step S656), the processes starting from Step S653 are repeated.

With reference to FIG. 8 again, further description is given. Subsequently to Step S511, the controller 300 checks whether the amount of toner inside the toner bottle 25 connected to the main driving device is nonzero (Step S512). If the amount of toner inside the toner bottle 25 connected to the main driving device is nonzero (Yes at Step S512), the controller 300 performs bottle toner filling control (Step S513). The bottle toner filling control is control for replenishing the toner storing unit 30 with toner by use of the toner sensor 37 inside the toner storing unit 30 and a bottle driving motor of the main driving device so that the amount of toner inside the toner storing unit 30 can reach a prescribed value. The bottle toner filling control is described in detail later. The foregoing prescribed value corresponds to a value exceeding the second predetermined value.

Figure 11:
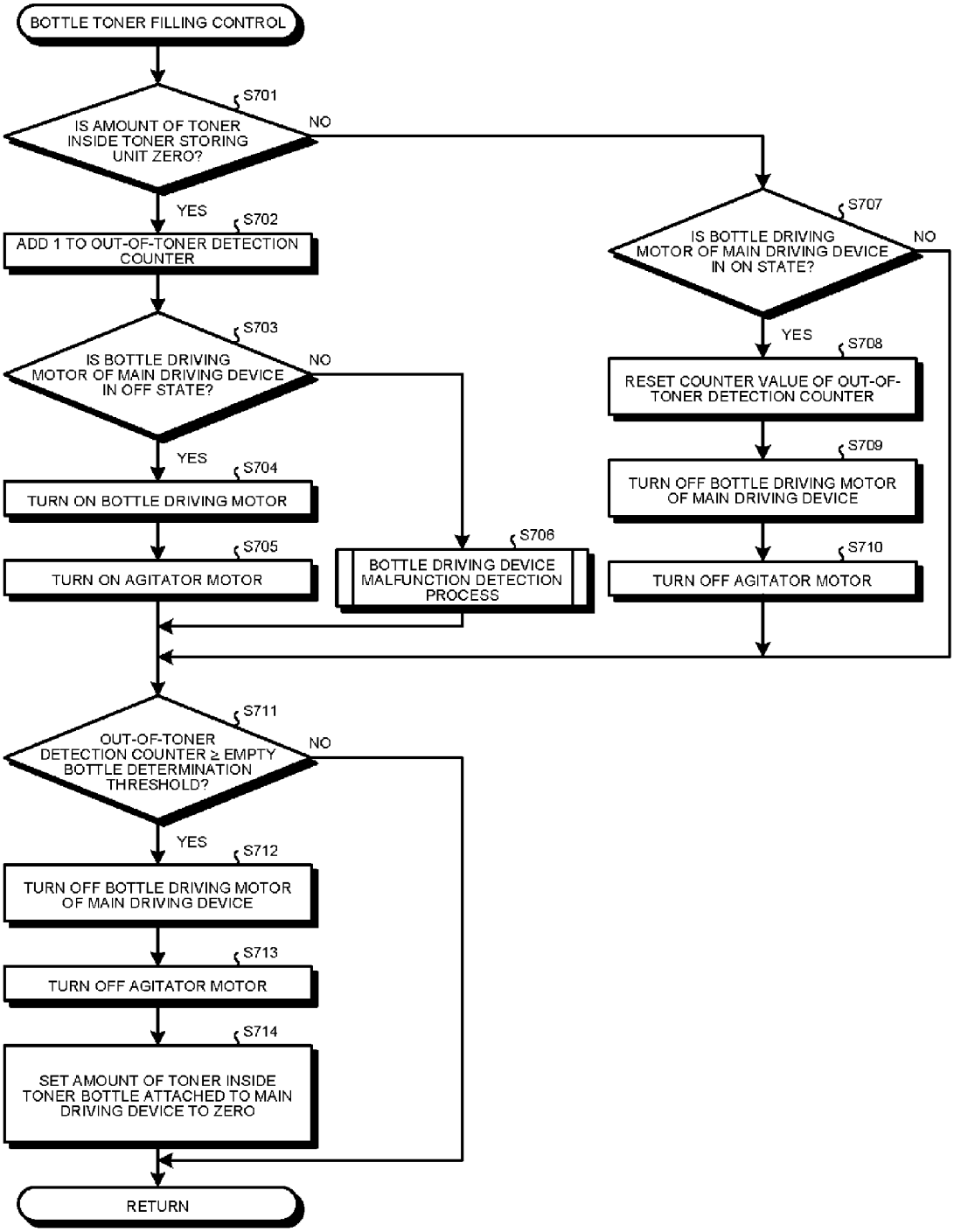
FIG. 11 is a flowchart illustrating exemplary bottle toner filling control.

FIG. 11 is a flowchart illustrating exemplary specific details of the bottle toner filling control. Based on output from the toner sensor 37, the controller 300 (the remaining amount detector 311) checks whether the amount of toner inside the toner storing unit 30 is zero (Step S701). If the amount of toner inside the toner storing unit 30 is zero (Yes at Step S701), the controller 300 (the system controller 317) adds 1 to an out-of-toner detection counter, which indicates the number of times the amount of toner has been detected as zero (Step S702), and then checks whether the bottle driving motor of the main driving device is in the non-operating state (in the OFF state) (Step S703). If the bottle driving motor of the main driving device is in the non-operating state (Yes at Step S703), the controller 300 (the driving controller 314) performs control for driving the bottle driving motor of the main driving device (Step S704). The controller 300 (the driving controller 314) further performs control for driving an agitator motor, which rotates the agitator 32 (Step S705). The process then proceeds to Step S711 to be described later. In essence, when the amount of toner inside the toner storing unit 30 is the second predetermined value, the controller 300 (the driving controller 314) performs control for driving the main driving device.

At Step S703 above, if the bottle driving motor of the main driving device is in operation (No at Step S703), the controller 300 (the system controller 317) executes a bottle driving device malfunction detection process (Step S706). The specific procedure of this process is to be described later.

On the other hand, if the amount of toner inside the toner storing unit 30 is not zero at Step S701 above (No at Step S701), the controller 300 (the system controller 317) checks whether the bottle driving motor of the main driving device is in the driving state (Step S707). If the bottle driving motor of the main driving device is in the non-operating state (No at Step S707), the process proceeds to Step S711 to be described later. If the bottle driving motor of the main driving device is in the driving state (Yes at Step S707), the controller 300 (the system controller 317) resets the out-of-toner detection counter to an initial value ("0" in this example) (Step S708). The controller 300 (the driving controller 314) then performs control for stopping operation of the bottle driving motor of the main driving device (Step S709) and performs control for stopping operation of the agitator motor (Step S710) at the same time. The process then proceeds to Step S711 to be described later.

At Step S711, the controller 300 (the system controller 317) then checks whether the out-of-toner detection counter is equal to or larger than an empty bottle determination threshold (a threshold for determining that the remaining amount of toner inside the toner storing unit 30 is zero). If the out-of-toner detection counter is equal to or larger than the empty bottle determination threshold (Yes at Step S711), the controller 300 (the system controller 317) determines that the main bottle has become empty. The controller 300 hence performs control for stopping operation of the bottle driving motor of the main driving device (Step S712) and performs control for stopping operation of the agitator motor (Step S713) at the same time. The system controller 317 then notifies the bottle controller 316 that the out-of-toner detection counter is equal to or larger than the empty bottle determination threshold. Upon being thus notified, the bottle controller 316 sets the amount of toner inside the toner bottle 25 connected to the main driving device to zero (Step S714). In essence, when the amount of toner inside the toner storing unit 30 has been successively determined a certain number of times to be the second predetermined value, the controller 300 (the bottle controller 316) sets the amount of toner inside the toner bottle 25 connected to the main driving device to the first predetermined value.

Figure 12:
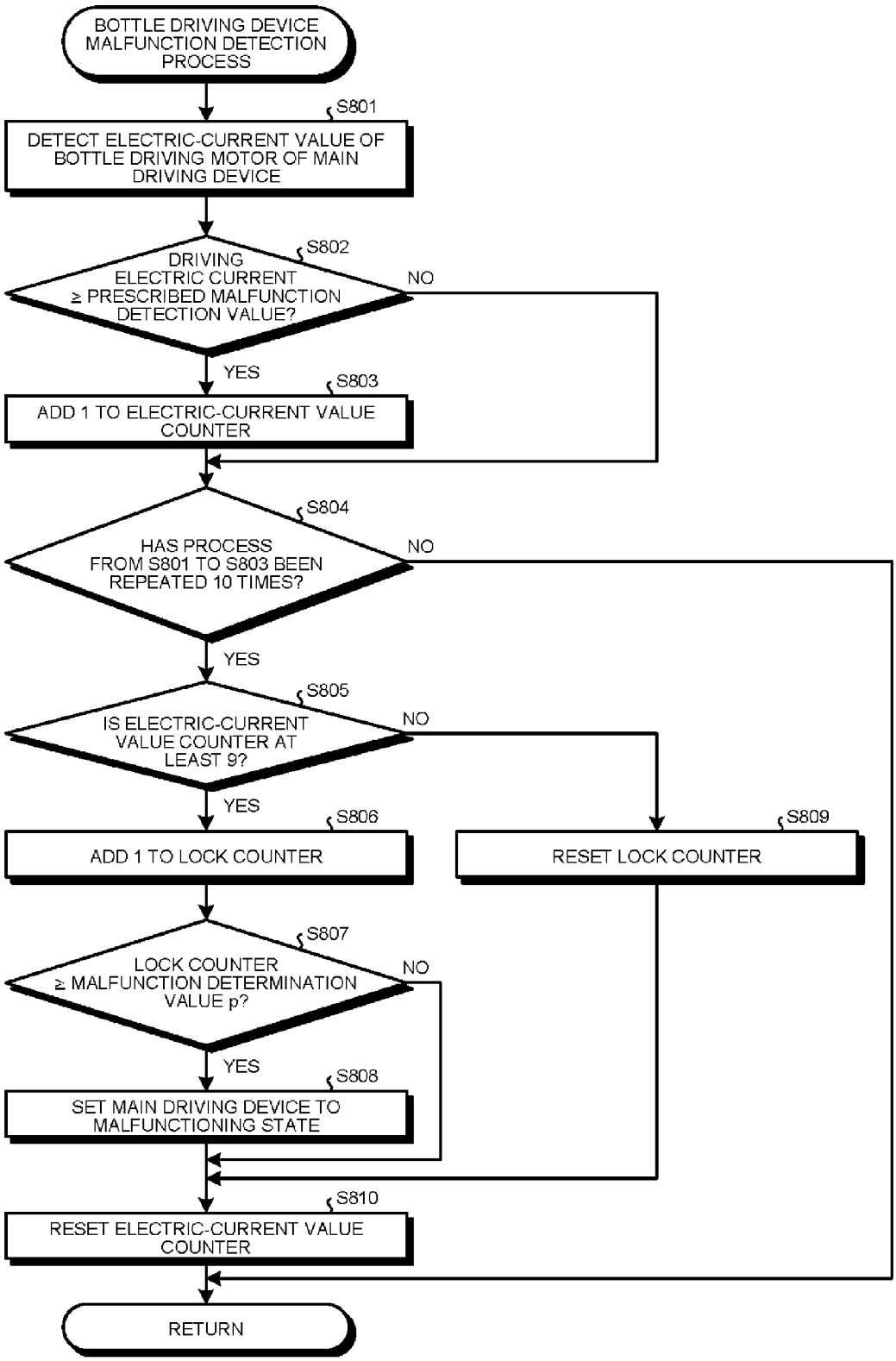
FIG. 12 is a flowchart illustrating an exemplary toner bottle malfunction detection process.

Next, the bottle driving device malfunction detection process described above in connection with Step S706 above is described with reference to FIG. 12. In the present embodiment, it is while the main driving device is in the driving state that the controller 300 executes the bottle driving device malfunction detection process in which it detects whether the main driving device is malfunctioning. FIG. 12 is a flowchart illustrating exemplary specific details of the bottle driving device malfunction detection process.

While the main driving device is in the driving state, the controller 300 (the malfunction detector 315) detects the electric-current value (the driving current) of the bottle driving motor of the main driving device at certain time intervals (Step S801), and checks whether the driving electric current is equal to or larger than a prescribed malfunction detection value (Step S802). The certain time intervals may be, for example, once every 100 ms, and the prescribed malfunction detection value for the driving electric current may be, for example, 600 mA. If the driving electric current is equal to or larger than a prescribed malfunction detection value (Yes at Step S802), the controller 300 (the malfunction detector 315) adds 1 to an electric-current value counter, which indicates the number of times the driving electric current is equal to or larger than the prescribed malfunction detection value (Step S803). On the other hand, if the driving electric current is less than a prescribed malfunction detection value (No at Step S802), the controller 300 (the malfunction detector 315) does not operate. The controller 300 (the malfunction detector 315) checks whether a series of processes at steps from Step S801 to Step S803 has been repeated 10 times (Step S804).

If the result of Step S804 is affirmative (Yes at Step S804), the controller 300 (the malfunction detector 315) checks whether the electric-current value counter is equal to or larger than 9 (Step S805). If the electric-current value counter is equal to or larger than 9 (Yes at Step S805), the controller 300 (the malfunction detector 315) adds 1 to a lock counter, which indicates a number based on which the bottle driving motor is determined to be overloaded (Step S806). If the lock counter is equal to or larger than a malfunction determination value p (Yes at Step S807), the controller 300 (the malfunction detector 315) determines the main driving device to be malfunctioning. The controller 300 (the bottle controller 316) then updates a piece of state information associated with the main driving device among the pieces of state information contained in the association information table to state information indicating that it is malfunctioning (Step S808). For example, it is assumed that a bottle driving device 28 identified with a piece of bottle driving device information "001" illustrated in FIG. 7 is a main driving device and that this main driving device has been determined to be malfunctioning. In this case, at Step S808 above, the piece of state information associated with the piece of bottle driving device information "001" is updated to state information (state information presenting "YES") that indicates being a malfunctioning state (refer to FIG. 13). Description is continued of FIG. 12. The controller 300 (the malfunction detector 315) then resets the electric-current value counter to an initial value ("0" in this example) (Step S810), and repeats the processes starting from Step S801.

In addition, if the electric-current value counter is less than 9 at Step S805 above (No at Step S805), the controller 300 (the malfunction detector 315) resets the lock counter to an initial value ("0" in this example) (Step S809), and the process at Step S810 is started. If the lock counter is less than a malfunction determination value p at Step S807 above (No at Step S807), the process at Step S810 is started also.

The malfunctioning state is thus determined after a malfunctioning state is successively continued in comparison between the driving electric current and the prescribed malfunction detection value. In this manner, erroneous detection due to transient electric current at the start of the driving, and erroneous detection in which a transient overloaded state is incorrectly detected as a malfunctioning state can be avoided. At the same time, in a manner like this one in which it takes long to determine the device to be malfunctioning, toner replenishment is suspended until it is determined to be so. Nevertheless, in a configuration having the toner storing unit 30 as in the case of the present embodiment, toner stored in the toner storing unit 30 can be supplied to the developing unit 112. Such a configuration thus has fewer troubles caused by the determination taking a long time, compared with a device configuration without the toner storing unit 30.

However, as described in connection with FIG. 11, the following point has to be kept in mind in the case of a method in which the main bottle is determined to be empty when, while the amount of toner inside the toner storing unit 30 is monitored, the toner storing unit 30 is not filled with toner even after the main driving device has been driven for a prescribed time. The point is that, in such a method, the time to be taken until the main driving device is detected as malfunctioning needs to be set shorter than the time until the main bottle is determined to be empty. Otherwise, the main driving device may possibly be switched to the other bottle driving device 28 based on determination of the emptiness of the main bottle before determination as to whether the main driving device is malfunctioning. This case can be avoided by setting the time until the lock counter exceeds the malfunction determination value p shorter than the time to be taken until the out-of-toner detection counter exceeds the empty bottle determination threshold. For example, the malfunction determination value p may be set to a smaller value than the empty bottle determination threshold.

In the above-described manner, in response to determination that a malfunction has occurred in the main driving device, a piece of state information associated with the main driving device among the pieces of state information contained in the foregoing association information is set to state information that indicates that it is malfunctioning. Furthermore, the amount of toner inside the toner bottle 25 connected to the main driving device is set to zero. Additionally, an indication that a malfunction has occurred in the main driving device (the bottle driving device 28 currently in use) may be displayed on the display device 203.

In the above-described manner, at the time when a malfunction has occurred, the amount of toner inside the toner bottle 25 connected to the main driving device is forcedly recognized as zero (the main bottle is forcedly recognized as empty). Consequently, as in the case when a toner bottle 25 has become empty in ordinary printing, when there is a bottle attached to the other bottle driving device 28, the operation is switched (the main driving device is switched), and toner replenishment to the toner storing unit 30 can be continued. Therefore, despite the occurrence of a malfunction in the main driving device currently in use, printing can be then continued without being stopped. Additionally, in the case of a bottle driving device 28 having a malfunction occurred therein, the amount of toner inside a toner bottle 25 connected to that bottle driving device 28 is determined to be zero even after the toner bottle 25 is attached thereto. Consequently, when the amount of toner inside a toner bottle 25 connected to the main driving device that functions normally has become zero, the main driving device is not switched to the bottle driving device 28 having a malfunction occurred therein (the main driving device is not switched thereto unless the malfunctioning state thereof is cleared).

When all of the bottle driving devices 28 have been determined to be malfunctioning, printing operation is stopped at the same time as an indication that all of the bottle driving devices 28 are malfunctioning is displayed. When at least one of the bottle driving devices 28 is in a malfunctioning state, the malfunctioning state thereof can be cleared with that bottle driving device 28 specified via an operation from the display device 203. Consequently, in a manner similar to clearance of the malfunctioning states of all of the bottle driving devices 28 when the power is turned ON, the specific bottle driving device 28 can be put into operation for toner replenishment.

With reference to FIG. 8 again, further description is given. At Step S512, if the amount of toner inside the toner bottle 25 connected to the main driving device is zero (No at Step S512), the controller 300 (the system controller 317) determines whether all of the bottle driving devices 28 are malfunctioning (Step S514). If the result of Step S514 is negative (No at Step S514), the controller 300 (the print controller 318) continues printing using toner remaining inside the toner storing unit 30, and performs toner end determination control (Step S515). In the toner end determination control, the controller 300 (the print controller 314) compares a previously set threshold and an end counter indicating the amount of toner expected to be used in actual printing, which is obtained from image data in printing data, and then performs control for stopping printing when the end counter exceeds the threshold. The foregoing threshold is previously set in accordance with an amount of toner that can be used after toner inside the toner storing unit 30 is used up and until a printing trouble occurs as a result of shortage of toner supply to the developing unit 112.

If the result of Step S514 above is affirmative (Yes at Step S514), the controller 300 (the system controller 317) stops printing operation and displays an indication of the malfunctioning state on the display device 203 (Step S516), and then stops the toner replenishment control. After the stoppage due to a malfunction, the image forming apparatus 100 transitions to a state inoperative for printing. However, the image forming apparatus 100 recovers from this state through the process at Step S503 above executed after the power is turned off and then on.

As described above, in the present embodiment, when the main driving device has been detected to be malfunctioning, the amount of toner inside the toner bottle 25 connected to the main driving device 28 is set to the first predetermined value, and driving of the main driving device is stopped. At the same time, when the other bottle driving devices 28 include any bottle driving device 28 having a toner bottle 25 connected thereto that contains toner the amount of which exceeds the first predetermined value, the main driving device is switched to that bottle driving device 28, which newly serves as the main driving device. For example, when a malfunction has occurred in the main driving device currently in use, the remaining amount of toner corresponding to the main driving device currently in use is set to the first predetermined value, and driving of the main driving device currently in use is then not allowed to continue. However, when the other bottle driving devices 28 include any bottle driving device 28 having a toner bottle 25 connected thereto that contains toner the amount of which exceeds the first predetermined value, the main driving device is switched to that bottle driving device 28 and printing is continued. Even when a malfunction has occurred in a bottle driving device 28 currently in use, printing can be continued by switching the bottle driving device 28 currently in use to another usable bottle driving device 28, and the occurrence of downtime (a time for which a system or a service is down) can be thus prevented.

Furthermore, in the present embodiment, when all of the bottle driving devices 28 are found malfunctioning in reference to the foregoing association information after the power is turned on, all of the pieces of state information associated with the respective bottle driving devices 28 are set to state information that indicates that they are not malfunctioning (the malfunctioning states thereof are cleared). Consequently, even though the bottle driving devices 28 are found malfunctioning, the malfunctioning states are automatically cleared when the power is turned on, and it is checked whether they can replenish the toner storing unit 30 with toner. The occurrence of downtime can be thus prevented also in this regard.

In addition, a computer program to be executed by the image forming apparatus 100 above (the CPU 301) may be provided as a file in an installable form or an executable form recorded in a computer-readable recording medium. Examples of the recording medium include a compact disc read only memory (CD-ROM), a flexible disc (FD), a compact disk recordable (CD-R), a digital versatile disk (DVD), and a universal serial bus (USB). Various computer programs may be configured to be provided or distributed via a network such as the Internet. Alternatively, various computer programs may be configured to be previously embedded in a ROM or the like to be provided.

According to the present invention, when a malfunction has occurred in a toner bottle driving device currently in use, the toner bottle currently in use can be switched to another usable toner bottle driving device.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A control device that drives a main driving device, the main driving device being a driving device among a plurality of driving devices each used to discharge recording material from a recording material container filled with the recording material to replenish, with the recording material, a recording material storing unit that stores the recording material, the main driving device having the recording material container connected thereto and being intended to be driven, the control device comprising:

a malfunction detector configured to detect malfunction of the main driving device;

a recording material amount setting unit configured to, when the malfunction detector has detected the malfunction of the main driving device, set information indicating an amount of the recording material in the recording material container connected to the main driving device to a first predetermined value;

a main driving device switching unit configured to, when an amount of the recording material in the recording material container connected to the main driving device is the first predetermined value, stop driving the main driving device and then, when the driving devices other than the main driving device include one driving device having a recording material container connected thereto that contains a recording material an amount of which exceeds the first predetermined value, switch the main driving device to the one driving device.

2. The control device according to claim 1, further comprising:

a memory that stores therein association information in which pieces of state information are associated with the respective driving devices, the state information indicating whether the respective driving devices are malfunctioning;

a state information initializing unit configured to, at a time of starting power supply to the control device, when all of the pieces of state information associated with the respective driving devices indicate that the driving devices are malfunctioning, initialize all of the pieces of state information associated with the respective driving devices to state information indicating that driving devices are not malfunctioning.

3. The control device according to claim 2, further comprising:

a driving controller configured to perform control for driving the main driving device when a remaining amount of the recording material in the recording material storing unit is a second predetermined value; and a state information setting unit configured to, when the malfunction detector has detected the main driving device as malfunctioning, set the piece of state information associated with the main driving device, among the pieces of state information contained in the association information, to a piece of state information indicating that the main driving device is malfunctioning.

4. The control device according to claim 2, wherein, when the driving device that has the recording material container attached thereto is not malfunctioning, the recording material amount setting unit sets information indicating an amount of a recording material in the recording material container connected to the driving device to a value exceeding the first predetermined value; and sets information indicating an amount of a recording material in the recording material container that does not have the recording material container connected thereto but is to be connected thereto, to the first predetermined value.

5. The control device according to claim 2, wherein processes that are performed by the recording material amount setting unit, the main driving device switching unit, and the driving controller are repeated at certain time intervals.

6. The control device according to claim 5, wherein, when an amount of the recording material in the recording material storing unit has been determined successively a certain number of times to be the second predetermined value, the recording material amount setting unit sets information indicating an amount of the recording material in the recording material container connected to the main driving device to the first predetermined value.

7. The control device according to claim 1, wherein the recording material is toner.

8. An image forming apparatus including a control device that drives a main driving device, the main driving device being a driving device among a plurality of driving devices each used to discharge recording material from a recording material container filled with the recording material to replenish, with the recording material, a recording material storing unit that stores the recording material, the main driving device having the recording material container connected thereto and being intended to be driven, the image forming apparatus comprising:

a recording material amount setting unit configured to refer to association information in which pieces of state information indicating whether the respective driving devices are malfunctioning are associated with the respective driving devices, and, when any one of the driving devices that have the recording material containers attached thereto is found malfunctioning, set an amount of the recording material inside the recording material container connected to the one of the driving devices to a first predetermined value; and a main driving device switching unit configured to, when an amount of the recording material in the recording material container connected to the main driving device is the first predetermined value, stop driving the main driving device and then, when the driving devices other than the main driving device include one driving device having a recording material container connected thereto that contains a recording material an amount of which exceeds the first predetermined value, switch the main driving device to the one driving device.

9. A control method performed by a control device that drives a main driving device, the main driving device being a driving device among a plurality of driving devices each used discharge recording material from a recording material container filled with the recording material to replenish, with the recording material, a recording material storing unit that stores the recording material, the main driving device having the recording material container connected thereto and being intended to be driven, the control method comprising:

referring to association information in which pieces of state information indicating whether the respective driving devices are malfunctioning are associated with the respective driving devices, and, when any one of the driving devices that have the recording material containers attached thereto is found malfunctioning, setting an amount of the recording material inside the recording material container connected to the one of the driving devices to a first predetermined value; and stopping, when an amount of the recording material inside the recording material container connected to the main driving device is the first predetermined value, driving the main driving device and then switching, when the driving devices other than the main driving device include one driving device having a recording material container connected thereto that contains a recording material an amount of which exceeds the first predetermined value, the main driving device to the one driving device.

* * * * *